US010054393B2

(12) United States Patent
Kedairy

(10) Patent No.: US 10,054,393 B2
(45) Date of Patent: Aug. 21, 2018

(54) FOLDING STOCK FOR A PISTOL OR OTHER FIREARM

(71) Applicant: Skychase Holdings Corporation, Alachua, FL (US)

(72) Inventor: Faisal Kedairy, Vienna (AT)

(73) Assignee: Skychase Holdings Corporation, Alachua, FL (US)

( * ) Notice: Subject to any disclaimer, the term of this patent is extended or adjusted under 35 U.S.C. 154(b) by 0 days.

(21) Appl. No.: 15/447,443

(22) Filed: Mar. 2, 2017

(65) Prior Publication Data

US 2017/0254613 A1 Sep. 7, 2017

Related U.S. Application Data

(60) Provisional application No. 62/303,028, filed on Mar. 3, 2016.

(51) Int. Cl.
*F41C 23/12* (2006.01)

(52) U.S. Cl.
CPC ..... *F41C 23/12* (2013.01)

(58) Field of Classification Search
CPC ..... F41C 23/04; F41C 23/10; F41C 23/12
USPC ..... 42/71.02, 72, 73
See application file for complete search history.

(56) References Cited

U.S. PATENT DOCUMENTS 305,537 A * 9/1884 Schwatka ..... F41C 23/04 42/72
517,555 A 4/1894 Reed
1,557,865 A 10/1925 Neel et al.
2,200,780 A * 5/1940 Schmeisser ..... F41C 23/04 42/72
2,424,944 A * 7/1947 Patchett ..... F41C 23/04 42/72
2,437,548 A 3/1948 George
3,256,632 A * 6/1966 Beretta ..... F41C 23/00 42/72
3,609,902 A * 10/1971 Casull ..... F41C 23/12 42/62
3,987,571 A 10/1976 Orozco
4,271,623 A * 6/1981 Beretta ..... F41C 23/12 42/71.02
4,383,384 A 5/1983 Fox
(Continued)

FOREIGN PATENT DOCUMENTS

BE 903241 A1 1/1986

OTHER PUBLICATIONS

European Search Report, completed May 9, 2017, for PCT/AT2017/060050.

*Primary Examiner* — Reginald S Tillman, Jr.
(74) *Attorney, Agent, or Firm* — Whitmyer IP Group LLC

(57) ABSTRACT

A detachable folding stock includes folding body sections and a folding butt that can be folded and assumes its operational orientation in either the extended or the folded positions of the stock. The detachable folding stock is removably mountable to a pistol, which is mounted thereon by means of a locking pistol frame stock rim to a pistol grip lock well, for instance using a catching locker. The detachable folding stock includes the lock well, which is attached to the body and into which the pistol grip fits. The detachable folding stock can assume its operational position in a magazine change operation without interrupting the pistol grip lock well during a magazine change operation.

20 Claims, 10 Drawing Sheets

(56) References Cited

U.S. PATENT DOCUMENTS

| | | | | | |
|---|---|---|---|---|---|
| 4,527,579 | A * | 7/1985 | Knotter | A45B 9/00 | 135/74 |
| 4,735,007 | A | 4/1988 | Gal | | |
| 4,788,785 | A * | 12/1988 | White | F41C 23/04 | 42/72 |
| 5,294,233 | A | 3/1994 | Kitahara et al. | | |
| 5,778,588 | A * | 7/1998 | Allen, III | F41C 23/12 | 42/71.02 |
| 7,552,557 | B1 * | 6/2009 | Mabry | F41A 11/04 | 42/71.01 |
| 8,061,072 | B1 * | 11/2011 | Crose | F41C 23/04 | 42/71.01 |
| 8,438,771 | B1 | 5/2013 | Boone | | |
| 8,464,458 | B2 * | 6/2013 | Chvala | F41C 23/04 | 42/73 |
| 8,910,407 | B2 * | 12/2014 | Singh | F41C 23/06 | 42/71.02 |
| 2011/0107644 | A1 * | 5/2011 | Faifer | F41C 23/04 | 42/75.02 |
| 2015/0276344 | A1 | 10/2015 | Denbleyker | | |

* cited by examiner

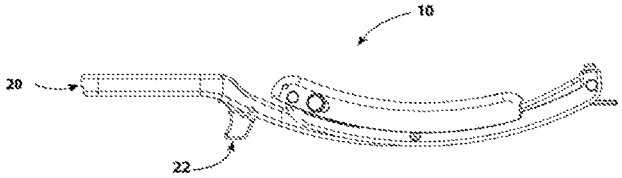
Fig. 2.a
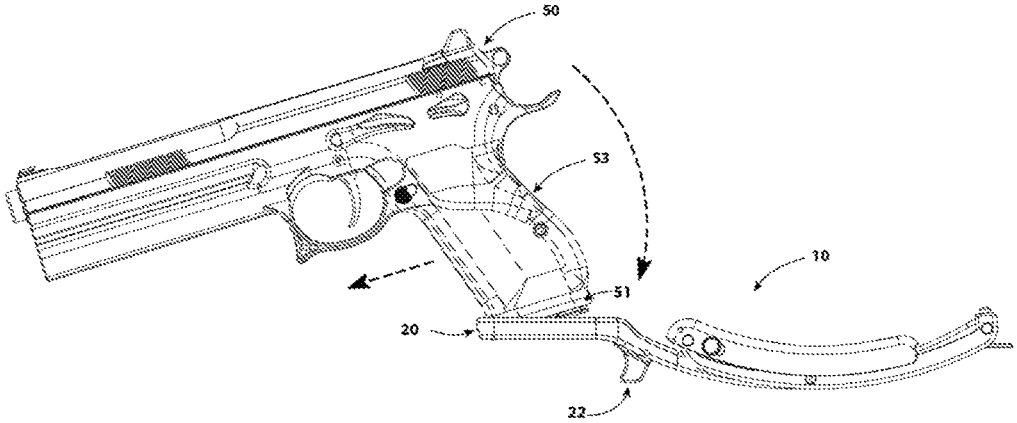
Fig. 2.b
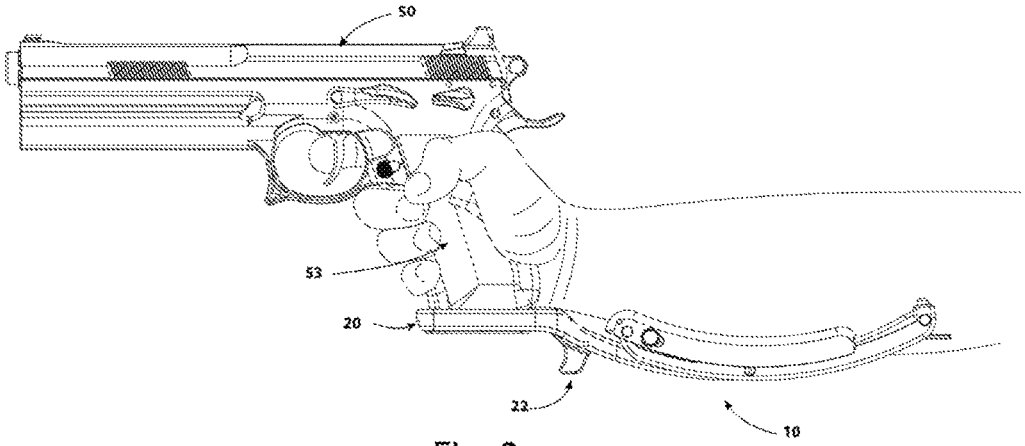
Fig. 2.c

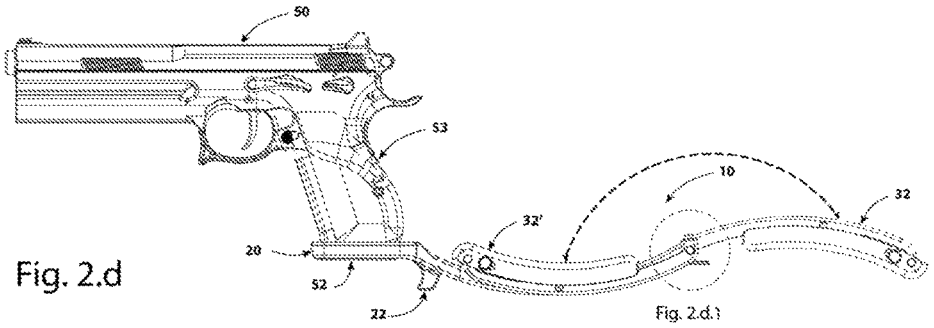
Fig. 2.d
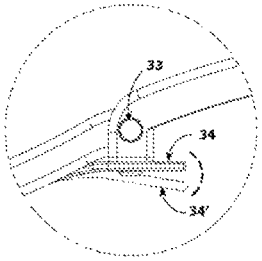
Fig. 2.d.1
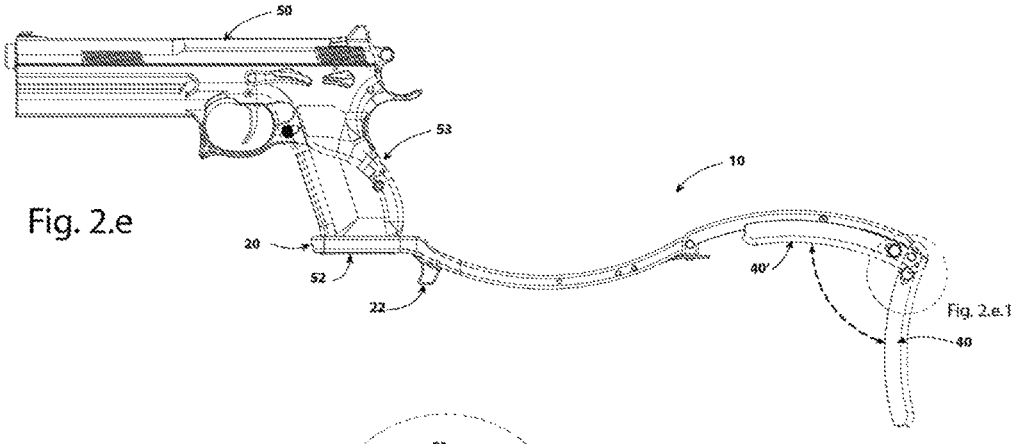
Fig. 2.e
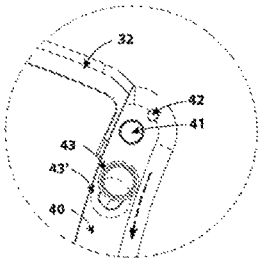
Fig. 2.e.1

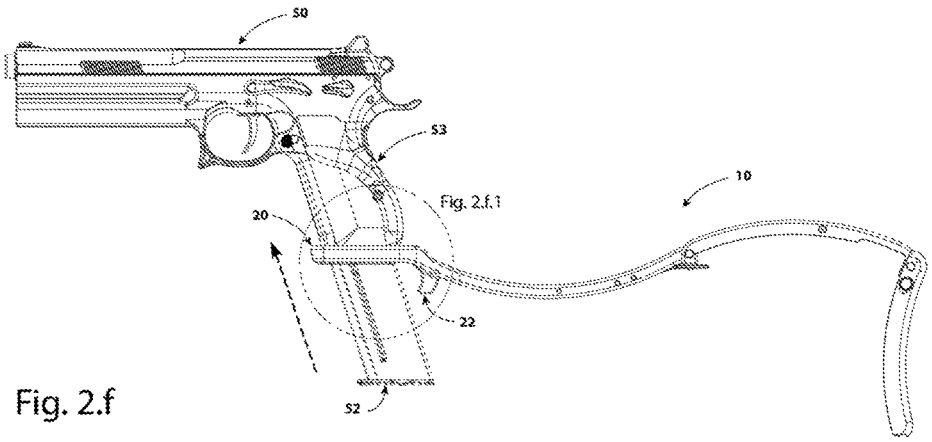
Fig. 2.f
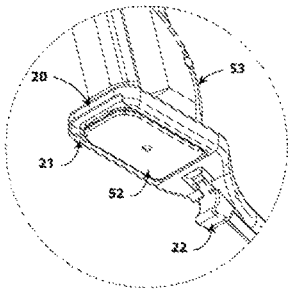
Fig. 2.f.1
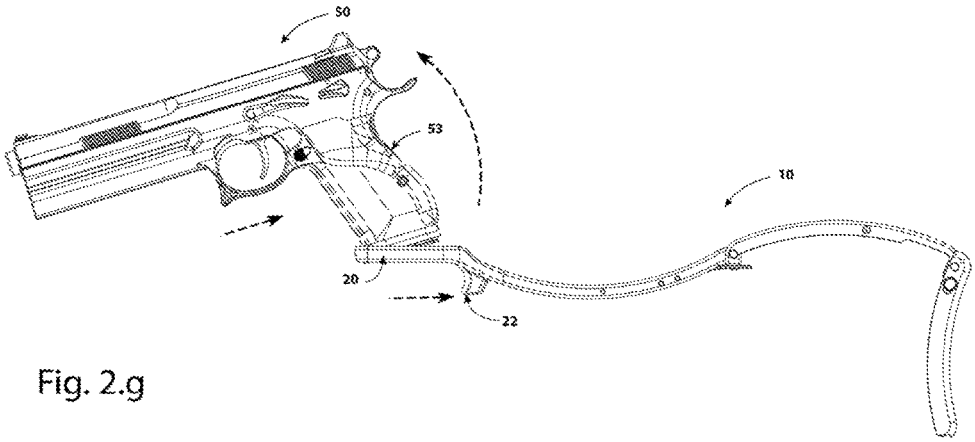
Fig. 2.g

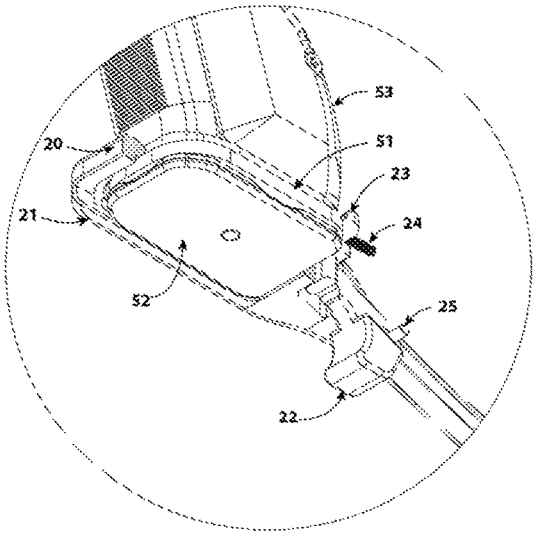
Fig. 3.a
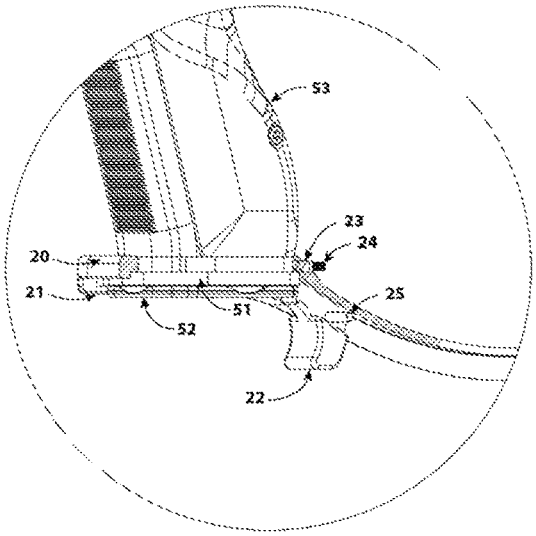
Fig. 3.b
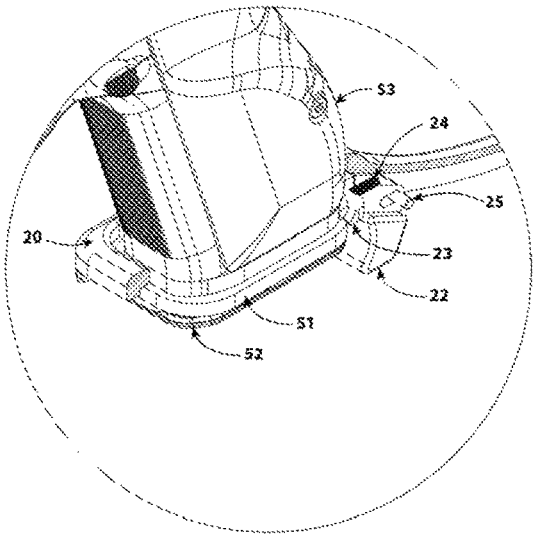
Fig. 3.c

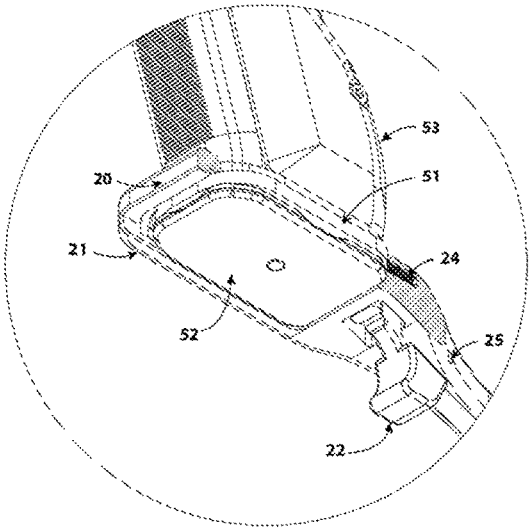
Fig. 4.a
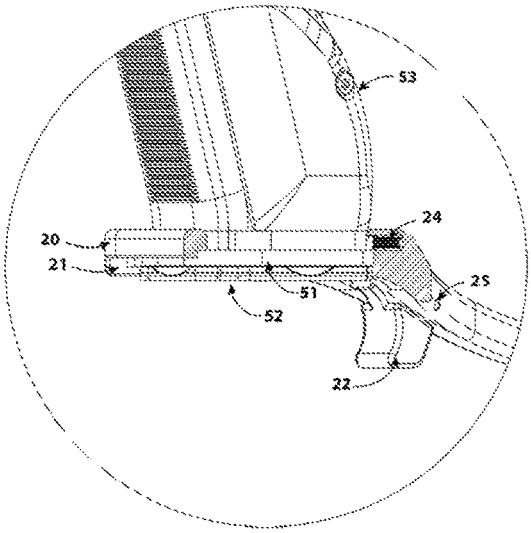
Fig. 4.b
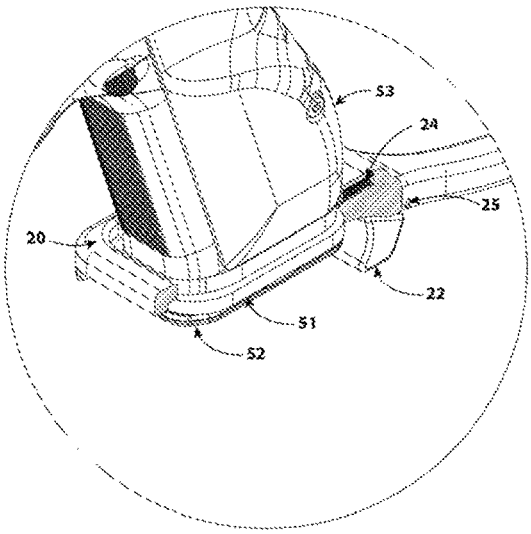
Fig. 4.c

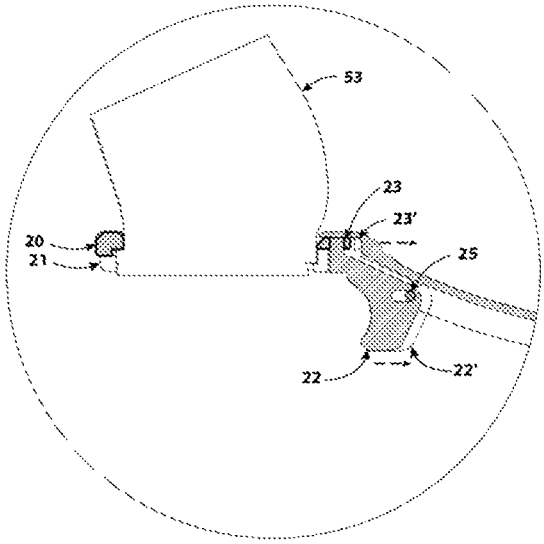
Fig. 5.a
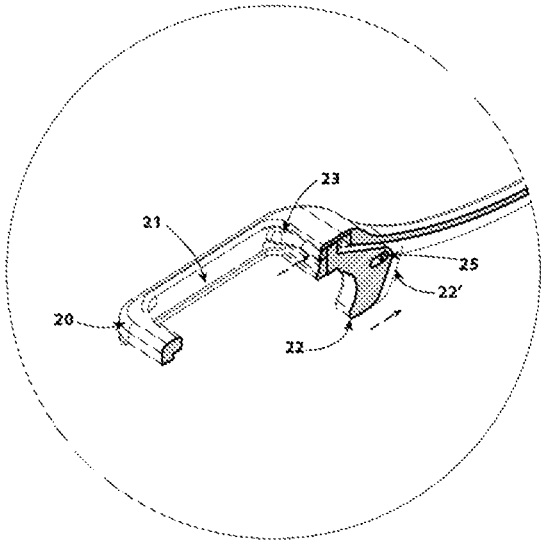
Fig. 5.b
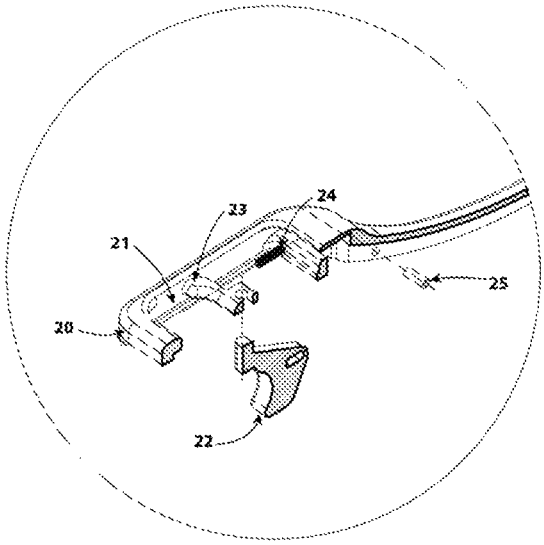
Fig. 5.c

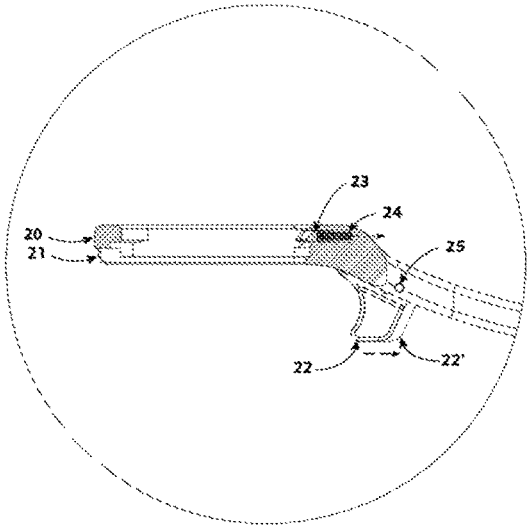
Fig. 6.a
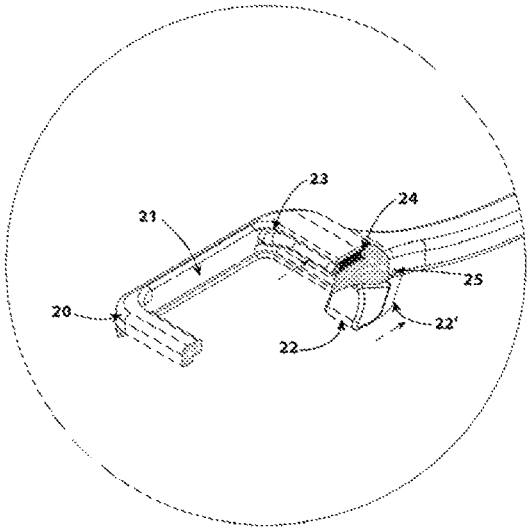
Fig. 6.b
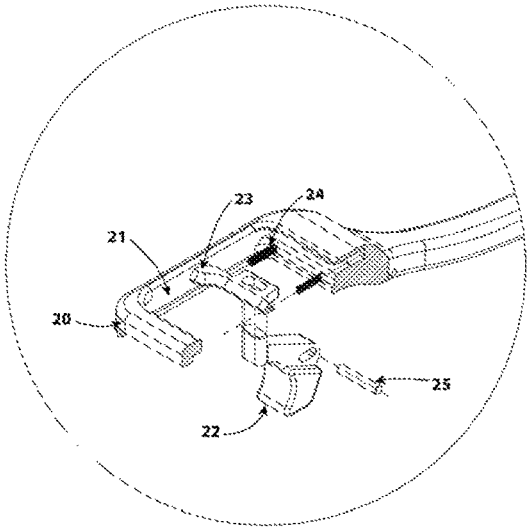
Fig. 6.c

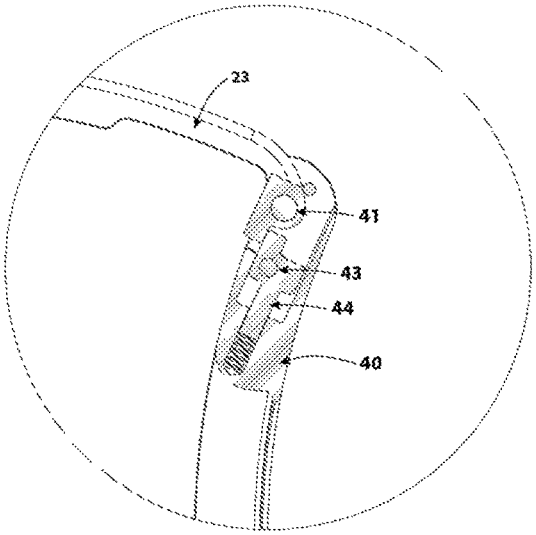
Fig. 7.a
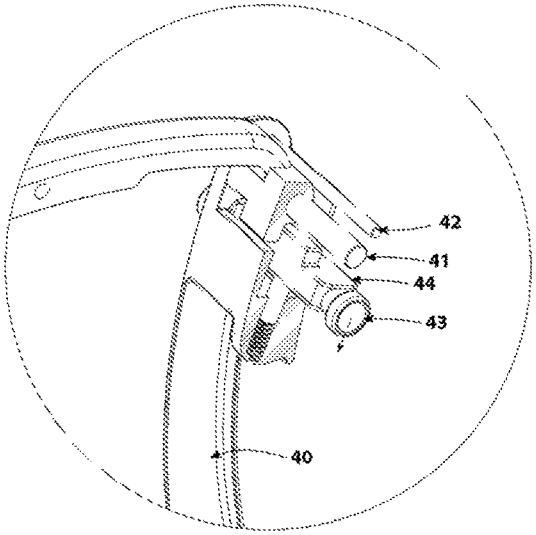
Fig. 7.b
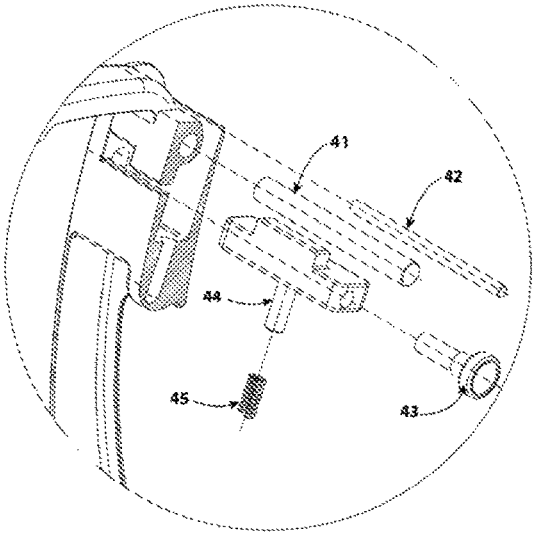
Fig. 7.c

FOLDING STOCK FOR A PISTOL OR OTHER FIREARM

FIELD OF THE INVENTION

The present invention relates to pistols and firearms in general, and more specifically to a firearm stock extension, as well as a pistol or firearm including a firearm stock extension.

Devices are known which serve as an extension for a pistol stock or as a butt for improving the grip on the firearm and handling during use. However, known extension devices are large and often unwieldy.

It is an object of the invention to provide a firearm stock extension which can be used with extant firearms, have low weight, and need little space when not in use. It is a further object of the invention to provide a firearm stock extension which allows handling of the firearm as well as magazines thereof during its use.

SUMMARY OF THE INVENTION

These and other objects are achieved by a firearm stock extension which includes at least two body sections which are foldable, as well as a folding butt. In one embodiment, the firearm stock extension comprises a first body section, a second body section and a folding butt, with said first and second body sections being foldable onto each other and said folding butt being foldable against the second body section. The stock extension is preferably attachable to a pistol at a connection location provided in the first body section.

The connection location may, advantageously, be a pistol grip lock well, which may be configured to cooperate with a rim on a pistol stock. Furthermore, a catching locker may be provided in the pistol grip lock well, with said catching locker configured to engage said pistol stock rim. In addition, the pistol grip lock well may be configured such that when assuming its operational position, it surrounds the pistol stock while not inhibiting passage of a magazine during insertion/extraction of said magazine in a magazine change operation.

In many preferred embodiments, the body sections are connected to each other by means of a pivoting link, allowing a pivoting movement around a respective horizontal axis. Moreover, the folding butt may be connected to the second body section by means of a second pivoting link, allowing a pivoting movement around a second horizontal axis. In case the body comprises more than two body sections, the additional section(s) may be located between the first and second body sections mentioned above.

Advantageously, embodiments of the firearm stock extension of the present invention may be attachable to the pistol at a pistol stock thereof, the pistol stock being located opposite to a barrel of said pistol.

The present invention also provides a pistol including a firearm stock extension of the kind mentioned above, with the pistol being removably attachable to the stock extension.

In accordance with the various embodiments, a detachable folding stock includes folding body sections and a folding butt that assumes an operational orientation in both the extended position and the folded position of the stock. The detachable folding stock is removably mountable to a pistol, which is mounted thereon by means of a locking pistol frame stock rim to a pistol grip lock well, for instance by using a catching locker. The detachable folding stock includes a lock well attached to the body, which is folded into (at least) two sections in a direction opposed to the barrel, and a folding butt. The detachable folding stock assumes its operational position in a magazine change operation without interfering with the pistol grip lock well. The detachable folding stock operates with a pistol grip lock well that the pistol grip fits into, in which it is releasably locked using a spring mechanism catch.

BRIEF DESCRIPTION OF THE DRAWINGS

The present invention is described in more detail with reference made to the following drawings, which show embodiments of the invention in schematic views:

FIGS. 2.*a-g* are side views of the detachable folding stock extension in several working positions, namely:

FIG. 2.*a* illustrates the detachable folding stock in a closed position,

FIG. 2.*b* illustrates pistol mounting directions to the detachable folding stock, FIG. 2.*c* illustrates the firing position on the folded positions of the detachable folding stock, FIG. 2.*d* illustrates unfolding of the body sections of the detachable folding stock, FIG. 2.*d*.1 is a detail view of the detachable folding stock body sections latch lock positions, FIG. 2.*e* illustrates unfolding of the detachable folding stock butt, FIG. 2.*e*.1 is a detail view of the detachable folding stock butt unfolding lock positions, FIG. 2.*f* illustrates changing the pistol magazine, FIG. 2.*f*.1 is a detail showing of a perspective view from below the magazine, showing the interrelation of the magazine and the detachable pistol grip lock well, and FIG. 2.*g* illustrates pistol unmounting directions for the detachable folding stock;

FIGS. 3.*a-c* are partial, longitudinal sectional views of the detachable folding stock locking parts for mounting to the pistol, namely:

FIG. 3.*a* is a partial, longitudinal sectional bottom isometric view,

FIG. 3.*b* is a partial, longitudinal sectional side isometric view, and

FIG. 3.*c* is a partial, longitudinal sectional top isometric view;

FIGS. 4.*a-c* are further partial, longitudinal sectional views of the detachable folding stock locking parts for mounting of the pistol, namely:

FIG. 4.*a* is a partial, longitudinal sectional bottom isometric view,

FIG. 4.*b* is a partial, longitudinal sectional side isometric view, and

FIG. 4.*c* is a partial, longitudinal sectional top isometric view;

FIGS. 5.*a-c* are yet further partial, longitudinal sectional views of the detachable folding stock locking mechanism without the pistol shown, namely:

FIG. 5.*a* is a partial, longitudinal sectional side view,

FIG. 5.*b* is a partial, longitudinal sectional isometric view, and

FIG. 5.*c* is a partial, longitudinal sectional exploded isometric view;

FIGS. 6.*a-c* are further partial, longitudinal sectional views of the detachable folding stock locking mechanism, namely:

FIG. 6.*a* is a partial, longitudinal sectional side view,

FIG. 6.*b* is a partial, longitudinal sectional isometric view, and

FIG. 6.*c* is a partial, longitudinal sectional exploded isometric view;

FIGS. 7.*a-c* are partial, longitudinal sectional views of the detachable folding stock butt locking mechanism of the folding stock body, namely:

FIG. 7.*a* is a partial, longitudinal sectional side view,

FIG. 7.*b* is a partial, longitudinal sectional isometric view, and

FIG. 7.*c* is a partial, longitudinal sectional exploded isometric view.

DETAILED DESCRIPTION OF THE INVENTION

With reference now to the drawings, exemplary embodiments of the invention will be described, with particular regard to instant detachable folding stock extension employing the principles and concepts of the present detachable folding stock extension and generally designated by the reference number 10. One preferred embodiment of a folding stock extension 10 is disclosed in the figures, wherein a pistol 50 is detachably securable to the folding stock extension 10.

The term "pistol", as used throughout this specification, should be taken to mean a handgun, a revolver, a pistol, or any other such hand-held firearm useable with the folding stock extension 10 as disclosed herein. Terms like "vertical" or "horizontal" refer to a position corresponding to the usual operating position of the pistol, i.e., the pistol barrel oriented above the pistol stock/grip. It will be evident to the person having ordinary skill in the art to freely combine several or all of the embodiments and variants discussed herein as deemed suitable for a specific application of the invention. Throughout this disclosure, terms like "advantageous", "exemplary" or "preferred" indicate elements or dimensions which are particularly suitable (but not necessarily essential) to the invention or an embodiment thereof, and may be modified wherever deemed suitable by the person having ordinary skill in the art, except where expressly required.

Referring to FIGS. 1 to 8, one embodiment of the present folding stock extension 10 is illustrated. The present folding stock extension 10 has been devised to support a pistol to increase accuracy when discharging said pistol 50.

Figure 1:
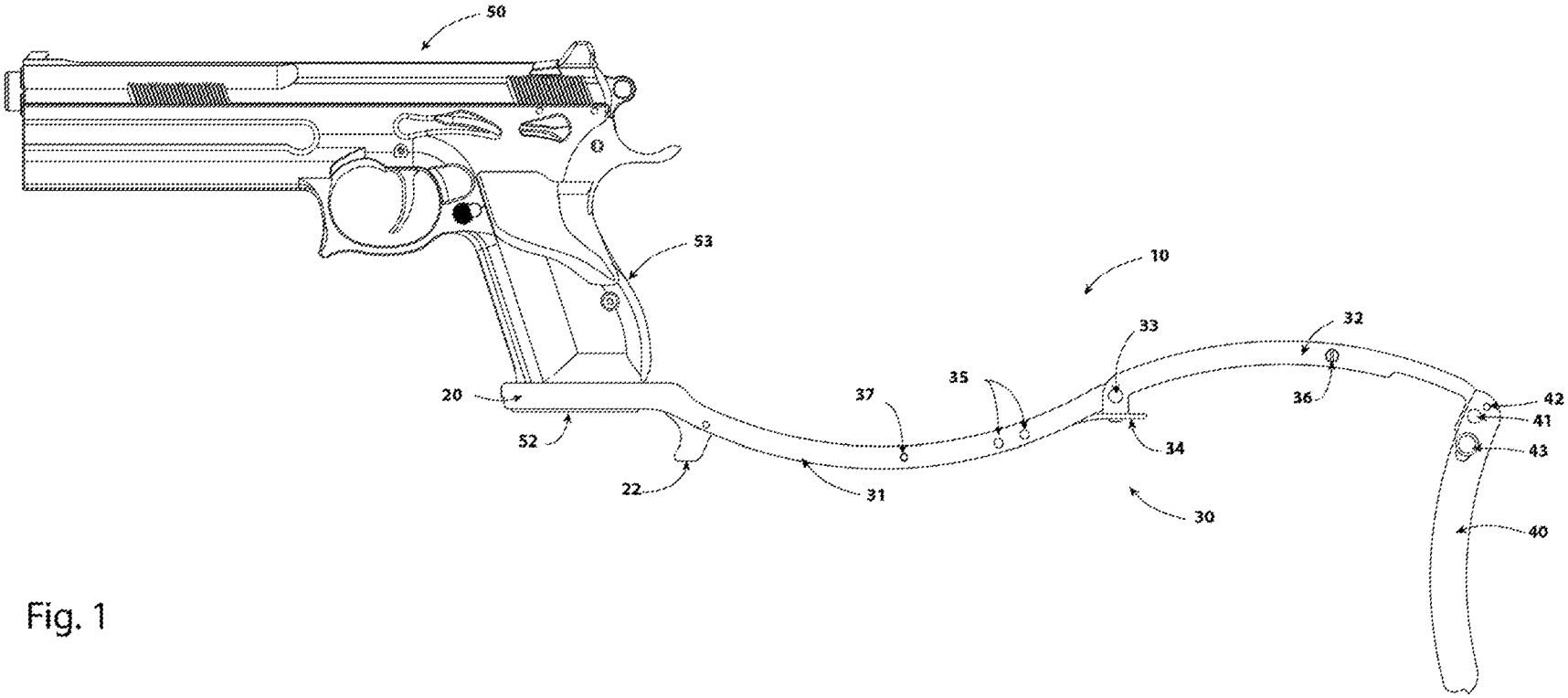
FIG. 1 is a side view of a pistol complete with a detachable folding stock extension according to an embodiment of the present invention.
Figure 8:
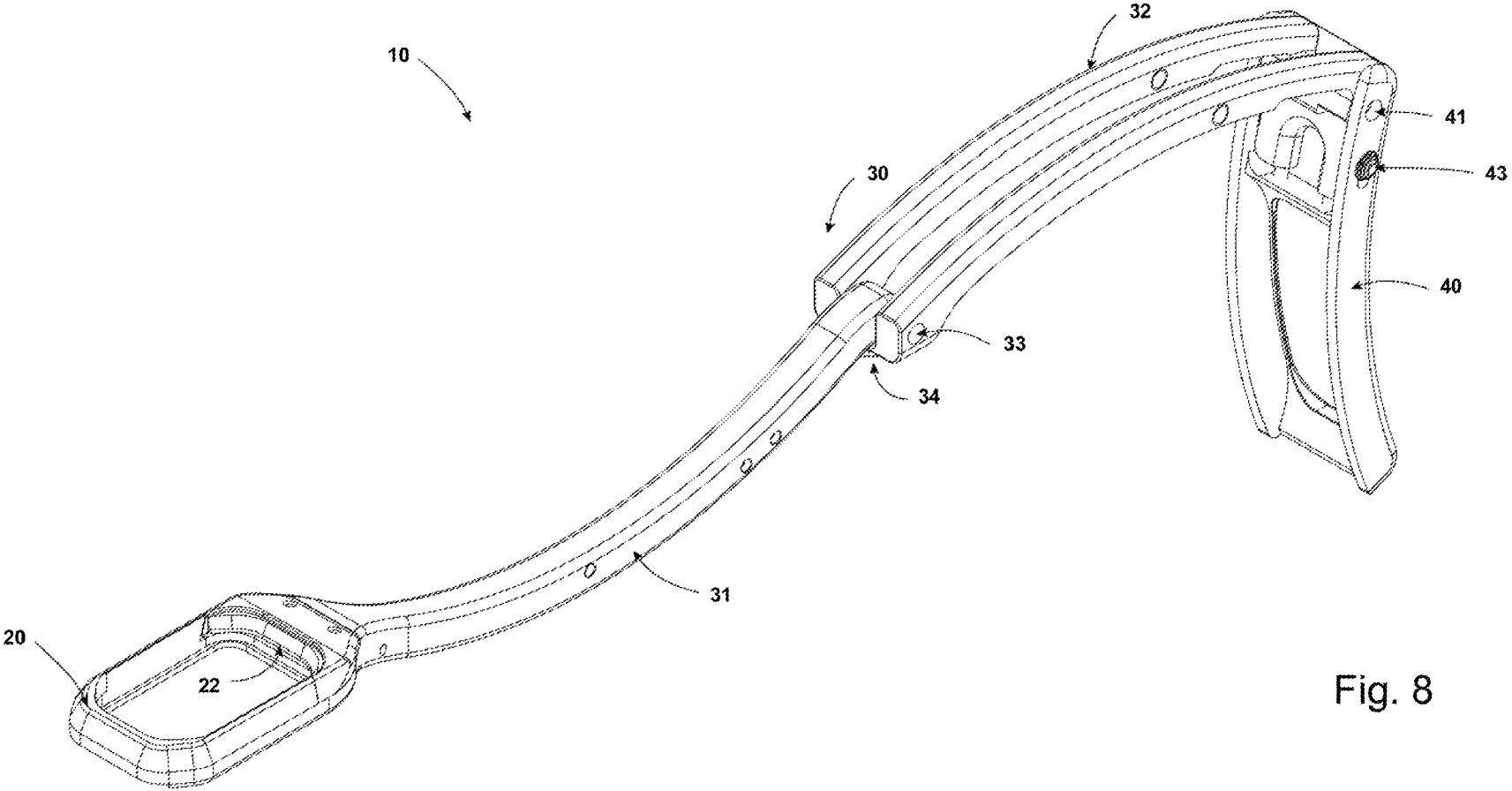
FIG. 8 is an isometric view of the folding stock extension of FIGS. 1-7.*c*.

Referring to FIG. 1, the folding stock extension 10 comprises a stock well lock 20 configured to mount a pistol on lock well groove 21 that fits the pistol stock rim 51. A folding body 30 of the folding stock extension 10 has (at least) two folding sections, i.e., folding body first/front section 31 and folding body second/back section 32. Body sections 31, 32 are devised to fold open to a direction located opposite to the barrel of the pistol 50, using pivoting joint that links body sections 31, 32 by means of transverse pin 33. This allows the user to lock folding body second/back section 32 in its open position 32 using latch/catching lock 34, and lock it in its closed position 32' (see FIG. 2.*d*.) by means of spring locking lock 36 moved to position 37. Furthermore, a folding butt 40 is provided that is able to fold from the body second/back section 32 in a direction opposite to the barrel of the pistol 50 using a pivoting joint to link the folding butt 40 to folding body 30 by means of transverse pin 41 (see FIGS. 7.*a-c*). This allows the user to lock folding butt 40 in its open position using position support pin 42, and unlock it for movement to its closed position using butt locking hand 43 that is pinned to butt locking plate 44.

Referring to FIGS. 2.*a-c*, the pistol 50 is mounted to the folding stock extension 10 at the position of the stock well lock 20. The stock well lock 20 is provided with a lock well groove 21 devised to support the pistol 50, and provide a surface against which the handle/grip 53 of the pistol 50 may be squeezed when discharging the pistol 50.

The embodiment may further comprise a reversed magazine catch locking system. The reversed magazine catch locking system locks the pistol stock rim 51 to the stock well lock 20 by means of frame stock rim catch plate 23 which is pushed into a locked position by frame stock rim catch plate spring 24. This enables locking of the pistol stock to the stock well lock 20. To unmount the pistol 50 from the stock well lock 20, a force applied to the pistol catching lock 22 to switch it from position 22 to 22' (see FIGS. 5 and 6) will guide the frame stock rim catch plate 23 from position 23 to 23', so as to release the pistol 50 and unmount it, as shown in FIG. 2.*g*. A pin 25 engages with the pistol catching lock 22, so that the pistol 50 may be removed from the stock well lock 20.

Referring to FIGS. 2.*d* and 2.*d*.1, folding body second/back section 32 is pivotally mounted to folding body first/front section 31 by means of transverse pin 33. The folding body second/back section 32 can be locked into its closed position 32' using spring locking lock 36 locked to the position 37. The folding body second/back section 32 can be released to extend in the direction opposite to the barrel of the pistol 50 toward open position 32, and in this movement the latch/catch lock 34 will be guided toward position 34' and come back again to position 34 when a pin-like element is seated in the correct position to lock the folding body second/back section 32 in the position denoted 32 in FIG. 2.*d*. The two pins 35 labeled in FIG. 1 are used to hold the latch/catch lock 34 in place.

Referring to FIGS. 2.*e* and 2.*e*.1 as well as FIGS. 7.*a-c*, folding butt 40 is pivotally mounted on transverse pin 41 to allow folding on body second/back section 32. The folding butt 40 can be locked into its closed position 40' using spring locking mechanism that pushes the butt locking plate 44. It can be unlocked by applying force on folding butt locking hand 43 toward position 43' that drives the butt locking plate 44 to position 44'.

In order to allow magazine change operations, as illustrated in FIGS. 2.*f* and 2.*f*.1, the lock well groove 21 is designed to avoid any interruption with the movement path of the magazine 52.

The longitudinal sectional views of FIGS. 3*a-c* and 4.*a-c* illustrate the interrelation between the folding stock extension 10, stock well lock 20, and frame stock rim catch plate 23 to the grip 53 of the pistol 50, pistol stock rim 51 form deferent positions.

FIGS. 5*a-c* and 6*a-c* show the interrelation between components of the stock well lock 20, their combination and working movement directions. It is also shown that the frame stock rim catch plate 23 is pushed by the frame stock rim catch plate spring 24 to the position 22 of FIG. 6.*b*, and guided by pistol catching lock 22 to the position 22' when pistol catching lock 22 is moved to the position 22'.

FIGS. 7*a-c* show the interrelation between the components of the locking parts of the folding butt 40, their combination and working movement directions. It is also shown that the butt locking plate 44 is pushed by the folding butt locking plate spring 45 to the position 43, and guided by folding butt locking hand 43 to the position 43' when folding butt locking hand 43 is moved to the position 43' (also see FIG. 2.*e*.1).

The invention claimed is:

1. A firearm stock extension including a first body section, a second body section, and a folding butt, the first and second body sections being foldable against each other and the folding butt being foldable against the second body section, said firearm stock extension being removably attachable to a pistol at a pistol grip lock well provided in the first body section, the pistol grip lock well configured to surround a rim on a bottom side of a stock of the pistol.

2. The firearm stock extension of claim 1, comprising a catching locker provided in the pistol grip lock well, the catching locker configured to engage said rim on the stock of the pistol.

3. The firearm stock extension of claim 1, wherein the pistol grip lock well, when in an operational position, is configured to surround the stock of the pistol while not inhibiting a passageway of a magazine of the pistol during insertion/extraction of the magazine into a grip of the pistol during a magazine change operation.

4. The firearm stock extension of claim 3, wherein the pistol grip lock well, when in an operational position, is configured to surround the stock of the pistol while not inhibiting a passageway of a magazine of the pistol during insertion/extraction of the magazine into a grip of the pistol during a magazine change operation.

5. The firearm stock extension of claim 1, wherein the first and second body sections are connected to each other by a first pivoting link allowing a pivoting movement around a first horizontal axis, and the folding butt is connected to the second body section by a second pivoting link allowing a pivoting movement around a second horizontal axis.

6. The firearm stock extension of claim 1, wherein the firearm stock extension is attachable to the pistol at a pistol stock thereof located in a direction opposite to a barrel of the pistol.

7. The firearm stock extension of claim 1, the firearm stock extension including a deferent locking system comprising a catch lock that is configured to lock to an open position of the folding butt and/or the first and second body sections.

8. A pistol including the firearm stock extension according to claim 1, the pistol being removably attachable to the firearm stock extension.

9. The firearm stock extension of claim 1, wherein the firearm stock extension is releasably locked to the pistol using a spring mechanism catch.

10. The firearm stock extension of claim 1, wherein the folding butt operates in at least two positions including a first position with the folding butt extended substantially perpendicular from the second body section, and a second position with the folding butt folded against the second body section.

11. The firearm stock extension of claim 1, wherein a locking system locks the pistol grip lock well to the rim on the stock of the pistol via a rim catch plate.

12. The firearm stock extension of claim 1, wherein the first body section has a first end and a second end, and the second body section has a first end and a second end, the second end of the first body section connects to the first end of the second body section via a first pivoting link;

wherein the folding butt has a first end and a second end, the first end of the folding butt connects to the second end of the second body section via a second pivoting link;

wherein the first body section, the second body section, and the folding butt fold substantially parallel against each other when in a closed position; and wherein in an open position, the second body section extends substantially parallel from the first body section in a direction located opposite to a barrel of the pistol, and the folding butt extends substantially perpendicular from the second body section.

13. The firearm stock extension of claim 1, wherein the first body section, the second body section, and the folding butt fold substantially parallel against each other when the firearm stock extension is in a closed position.

14. A firearm stock extension for a pistol, the firearm stock extension comprising:

a first body section having a pistol grip lock well configured to surround rim on a bottom side of a stock of the pistol, said firearm stock extension removably attachable to the pistol at the pistol grip lock well;

a second body section connected to the first body section via a first link, the second body section foldable against the first body section; and a butt connected to the second body section via a second link, the butt foldable against the second body section.

15. The firearm stock extension of claim 14, wherein the pistol grip lock well, when in an operational position, is configured to surround the stock of the pistol and allows for insertion/extraction of a magazine into a grip of the pistol.

16. The firearm stock extension of claim 14, wherein the butt operates in at least two positions including a first position with the butt extended substantially perpendicular from the second body section, and a second position with the butt folded against the second body section.

17. A firearm stock extension for a pistol, the firearm stock extension comprising:

a first body section with a first end and a second end, the first end of the first body section includes a pistol grip lock well configured to surround a rim on a bottom side of a stock of the pistol;

a second body section with a first end and a second end, the second end of the first body section connects to the first end of the second body section via a first link; and a butt with a first end and a second end, the first end of the butt connects to the second end of the second body section via a second link;

wherein the first body section, the second body section, and the butt fold substantially parallel against each other when in a closed position; and wherein in an open position, the second body section extends from the first body section in a direction boated opposite to a barrel of the pistol, and the folding butt extends substantially perpendicular from the second body section.

18. The firearm stock extension of claim 17, wherein the pistol grip lock well, when in an operational position, is configured to surround the stock of the pistol and allows for insertion/extraction of a magazine into a grip of the pistol.

19. The firearm stock extension of claim 17, wherein the butt operates in at least two positions including a first position with the butt extended substantially perpendicular from the second body section, and a second position with the butt folded against the second body section.

20. The firearm stock extension of claim 17, wherein the pistol grip lock well is configured to be removably engaged with the bottom side of the stock of the pistol.

* * * * *